US005272459A

United States Patent [19]

Geery

[11] Patent Number: 5,272,459

[45] Date of Patent: Dec. 21, 1993

[54] STANDARDIZED AND SELF-CONTAINED TRANSFORMER BATTERY CHARGER ASSEMBLY

[75] Inventor: Michael J. Geery, Newhall, Calif.

[73] Assignee: Xenotronix Inc., Valencia, Calif.

[21] Appl. No.: 915,523

[22] Filed: Jul. 20, 1992

[51] Int. Cl.[5] ..... H01F 27/02

[52] U.S. Cl. ..... 336/61; 336/92; 336/107; 336/105

[58] Field of Search ..... 336/61, 92, 105, 107, 336/198, 208

[56] References Cited

U.S. PATENT DOCUMENTS

| | | | |
|---|---|---|---|
| 2,375,309 | 5/1945 | McCoy | 336/208 |
| 2,967,267 | 1/1961 | Steinman et al. | |
| 3,108,763 | 10/1963 | Ahlene | |
| 3,346,828 | 10/1967 | Buschman | |
| 3,391,384 | 7/1968 | Hughes | 336/92 X |
| 3,418,552 | 12/1968 | Holmes | |
| 3,544,937 | 12/1970 | Boysen | |
| 3,549,990 | 12/1970 | Hochheiser | |
| 3,675,108 | 7/1972 | Nicholl | |
| 3,824,519 | 7/1974 | Miller | 336/208 X |
| 3,840,795 | 10/1974 | Roszyk et al. | |
| 4,028,654 | 6/1977 | Bullard et al. | 336/92 |
| 4,205,291 | 5/1980 | Flentge | 336/92 |
| 4,206,435 | 6/1980 | Harris et al. | 336/65 |
| 4,250,479 | 2/1981 | Bausch et al. | 336/208 |
| 4,257,027 | 3/1981 | Yasuhisa | 336/192 |
| 4,347,490 | 8/1982 | Peterson | 336/198 X |
| 4,519,015 | 5/1985 | Lin | 336/107 X |
| 4,660,014 | 4/1987 | Wenaas et al. | 336/92 X |
| 4,661,792 | 4/1987 | Watkins | 336/65 |
| 4,748,405 | 5/1988 | Brodzik et al. | 336/65 X |
| 4,835,841 | 6/1989 | Gunnels et al. | 336/198 X |
| 4,897,627 | 1/1990 | Van Wagener et al. | 336/65 |
| 4,901,182 | 2/1990 | Book | 336/105 X |
| 4,916,424 | 4/1990 | Kijima | 336/160 |
| 4,939,623 | 7/1990 | Equi et al. | 336/107 X |
| 5,004,974 | 4/1991 | Cattaneo et al. | 336/65 X |

*Primary Examiner*—Lincoln Donovan
*Assistant Examiner*—L. Thomas
*Attorney, Agent, or Firm*—Thomas I. Rozsa; Dong Chen

[57] ABSTRACT

The present invention is a standardized transformer battery charger assembly for assembling a self-contained transformer battery charger with a built-in printed circuit board (PCB). The transformer batter charger assembly comprises a two-piece casing for housing a transformer unit and the printed circuit board. The PCB has a heat exchange relationship with the casing. The transformer unit includes a primary piece having a primary bobbin for accommodating a primary winding, and a secondary piece having a secondary bobbin for accommodating a secondary winding. The assembly also comprises electrical input pins mounted to the primary piece and connectable with the primary winding, secondary pins non-twistably and non-extractably attached to the secondary piece for supporting the PCB and electrically connecting the secondary winding with input terminals of the PCB, and terminal strips non-twistably and non-extractably attached to the primary piece and non-rotatably interlocking the second piece and also supporting the PCB at another end, and further electrically connected with output terminals of the PCB for serving as output terminals of the transformer battery charger. With the standardized transformer battery charger assemblies, various self-contained transformer battery charges with customized characteristics can be produced by selecting a desired combination of the respective number of windings on the primary and secondary bobbins and selecting suitable PCBs.

26 Claims, 4 Drawing Sheets

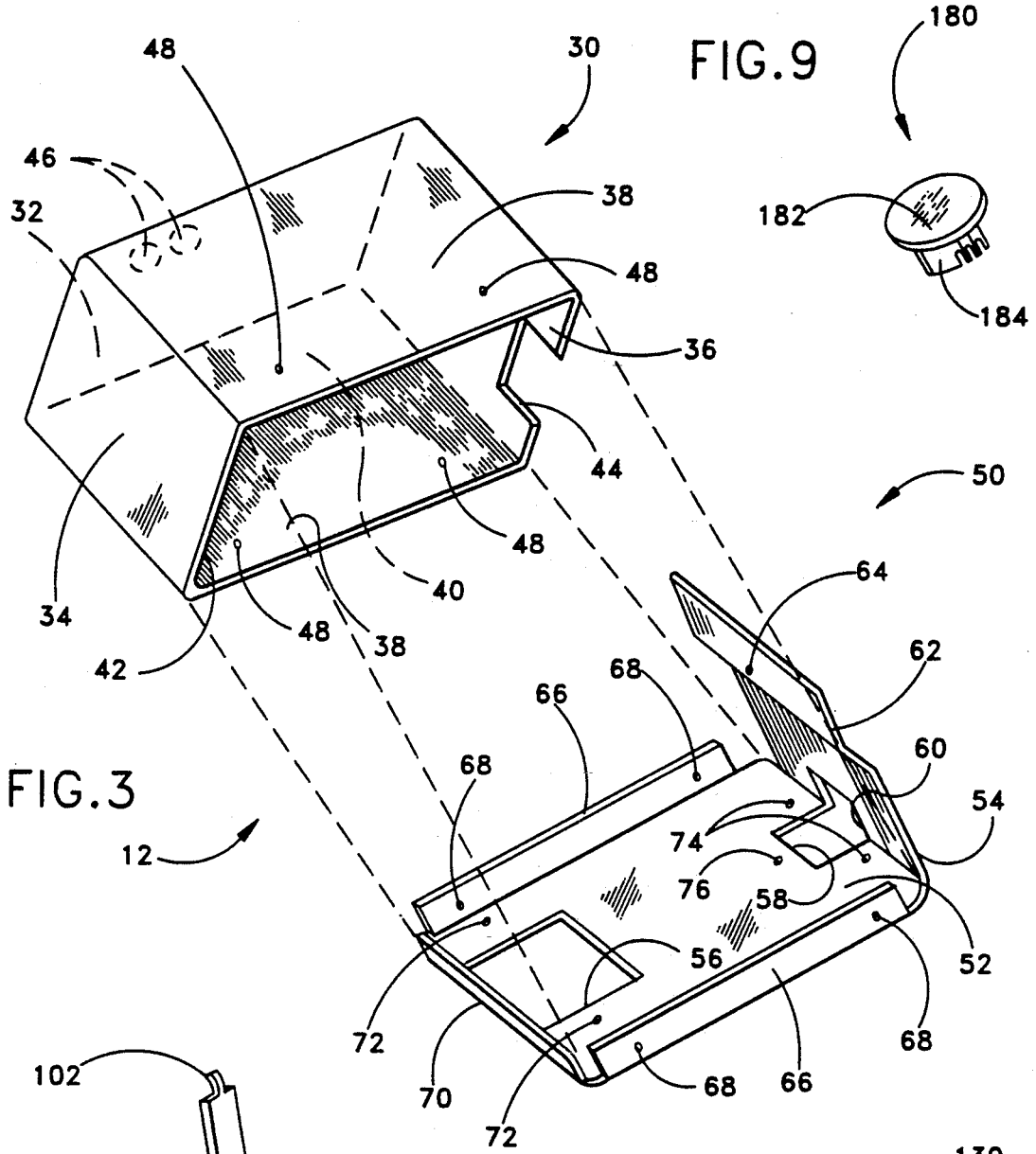
FIG.3
FIG.9
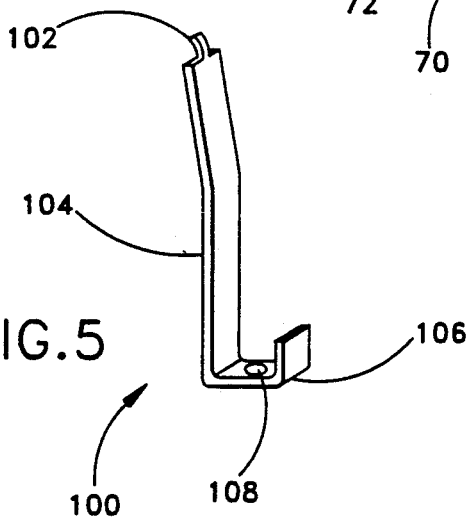
FIG.5
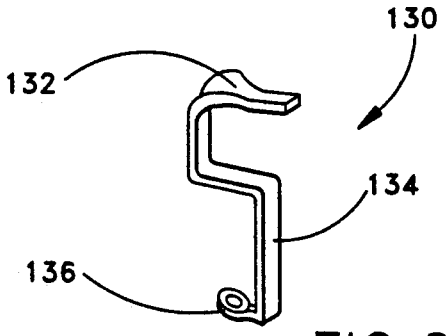
FIG.6

STANDARDIZED AND SELF-CONTAINED TRANSFORMER BATTERY CHARGER ASSEMBLY

BACKGROUND OF THE INVENTION

1. Field of The Invention

The present invention relates to the field of transformers and battery chargers, and more particularly, the field of transformer battery chargers.

2. Description of The Prior Art

Transformers are old in the art. Battery chargers have also been developed with the utilization of rechargeable batteries. There are certain types of battery chargers which have utilized transformers as part of their assemblies. The following thirteen (13) prior art patents have been uncovered, which are relevant to the pertinent fields of art.

1. U.S. Pat. No. 2,375,309 issued to McCoy on May 8, 1945 for "High Frequency Transformer" (hereafter the "McCoy Patent").

2. U.S. Pat. No. 2,967,267 issued to Steinman et al. on Jan. 3, 1961 for "Reactive Intercoupling of Modular Units" (hereafter the "Steinman Patent").

3. U.S. Pat. No. 3,108,763 issued to Ahlene on Oct. 29, 1963 for "Coil Form" (hereafter the "Ahlene Patent").

4. U.S. Pat. No. 3,346,828 issued to Buschman on Oct. 10, 1967 for "Transformer Assembly For Varying Electrical Parameters And Method Of Constructing The Same" (hereinafter the "Buschman Patent").

5. U.S. Pat. No. 3,418,552 issued to Holmes on Dec. 24, 1968 for "Separable Transformer Battery Charger" (hereafter the "Holmes Patent").

6. U.S. Pat. No. 3,549,990 issued to Hochheiser on Dec. 22, 1970 for "Non-Sparking A-C Connectors" (hereafter the "Hochheiser Patent").

7. U.S. Pat. No. 3,544,937 issued to Boysen on Dec. 1, 1970 for "Coil Supporting Plates" (hereafter the "Boysen Patent").

8. U.S. Pat. No. 3,675,108 issued to Nicholl on Jul. 4, 1972 for "Induction Charging Device" (hereafter the "Nicholl Patent").

9. U.S. Pat. No. 3,840,795 issued to Roszyk et al. on Oct. 8, 1974 for "Hand Held Battery Operated Device And Charging Means Therefor" (hereafter the "Roszyk Patent").

10. U.S. Pat. No. 4,250,479 issued to Bausch et al. on Feb. 10, 1981 for "Transformer Bobbin Assembly" (hereafter the "Bausch Patent").

11. U.S. Pat. No. 4,257,027 issued to Yasuhisa on Mar. 17, 1981 for "Transformer Bobbin Assembly" (hereafter the "Yasuhisa Patent").

12. U.S. Pat. No. 4,661,792 issued to Watkins on Apr. 28, 1987 for "Apparatus For Mounting Printed Circuit Boards" (hereafter the "Watkins Patent").

13. U.S. Pat. No. 4,916,424 issued to Kijima on Apr. 10, 1990 for "Electric Part In The Form Of Windings" (hereafter the "Kijima Patent").

Most of the above referenced prior art patents are related to the design and construction of transformers themselves, or simply the design and construction of transformer bobbins alone. The only prior art patents related to the design and construction of transformer battery charger assemblies are the Holmes Patent and the Roszyk Patent. In addition, there is only one prior art patent, the Watkins Patent, which is related to the technique of mounting a printed circuit board (hereafter referred to as "PCB") together with a transformer assembly.

The Watkins Patent discloses an apparatus for mounting a primary PCB, a secondary PCB and a transformer. The mounting apparatus includes a bobbin having standoffs for supporting the secondary PCB in a parallel relationship with the primary PCB, and retaining the transformer therebetween. The standoffs have many connector pins for alignment. The Watkins Patent, however, is generally related to large PCBs used in major electronic equipment such as computers. It is not related to an apparatus for recharging rechargeable batteries.

The Holmes Patent discloses a separable transformer battery charger, which is utilized in an automatic toothbrush pack. The primary winding is retained with a base, and the secondary winding is retained with the toothbrush handle. The primary winding and secondary windings are positioned in stacked relationship and flux-linked by a common magnetic stud. Half of the stud extends through the primary winding and the other half extends through the secondary winding. The Holmes Patent is not designed for recharging independent rechargeable batteries and does not have any electronic circuitry for monitoring and controlling the charging process.

The Roszyk Patent discloses a transformer battery charger, which is also utilized in an automatic toothbrush pack. The primary winding is retained with a base, and the secondary winding is retained with the toothbrush handle. The primary winding and secondary winding are positioned in either stacked or side-by-side relationships. Again, the Roszyk Patent is not designed for recharging independent rechargeable batteries and does not have any electronic circuitry for monitoring and controlling the charging process.

The following prior art patents are generally related to the design and construction of transformers.

The McCoy Patent discloses a transformer assembly which has separable bobbins. The cylindrical secondary bobbin is placed within the hollow cylindrical primary bobbin. A flat supporting plate is utilized for retaining the primary and secondary bobbins. The McCoy Patent is related to the transformers used for transferring radio frequencies.

The Buschman Patent discloses a transformer assembly with standard interchangeable cores and windings. The two interchangeable windings are retained by the core in a stacked relationship.

The Hochheiser Patent discloses an alternate current (AC) connector which includes a transformer assembly. The transformer assembly includes a plurality of pairs of U-shaped primary and secondary windings. Each pair of primary and secondary windings are oppositely disposed with a narrow gap in between.

The Boysen Patent discloses a pair of bobbin supporting plates. The pair of supporting plates are disposed in parallel relationship and support two transformer bobbins in a side-by-side relationship.

The Kijima Patent discloses a five-piece transformer assembly. The five-piece transformer assembly includes an inner bobbin, a top half piece and a bottom half piece which form an outer bobbin, and two E-shaped cores. The inner bobbin is aligned with the outer bottom piece by several pins.

The following prior art patents are simply related to the design and construction of transformer bobbins. The Ahlene Patent discloses a bobbin assembly which is formed by six individual flat pieces. The six pieces are interlocked with one another to form a generally rectangular shaped bobbin.

The Yasuhisa Patent discloses a four-piece bobbin assembly. The four-piece bobbin assembly includes an outer frame bobbin, an inner frame bobbin and a pair or protective covers.

The Bausch Patent discloses a bobbin assembly which includes a pair of primary-secondary shields for interlinking one primary bobbin and two secondary bobbins. The primary bobbin is sandwiched between the two secondary bobbins.

The rest of the prior art patents are generally related to the assemblies of electronic components. The Steinman Patent discloses an intercoupling modular assembly, which includes a multiplicity of modular units intercoupled and retained in a rectangular shaped cabinet. Each of the modulars may be independently removed and replaced. The Steinman Patent is related to electronic equipment, such as a digital computer, which has a large amount of stacked modular units.

The Nicholl Patent discloses an apparatus for recharging the rechargeable battery contained in small appliances. The apparatus is designed to have a large quantity of identical small appliances charged successively.

It is desirable to design and construct transformer battery chargers that are used directly for charging independent rechargeable batteries not contained in small electronic appliances. In addition, it is desirable to make transformer battery chargers with various characteristics to suit different types of rechargeable batteries respectively. It is further desirable to increase the efficiency and reduce the cost of manufacturing transformer battery chargers with different characteristics.

SUMMARY OF THE INVENTION

The present invention is a standardized and self-contained transformer battery charger assembly.

It has been discovered, according to the present invention, that there is a growing desire of using transformer battery chargers to charge independent batteries. However, there is a particular problem with charging independent batteries. Independent rechargeable batteries are manufactured in many varieties. Different types of rechargeable batteries have different parameters. For example, the respective output potential of rechargeable batteries may be 3 volts, 6 volts, 9 volts, etc. Accordingly, different battery chargers are required. For example, the battery chargers will be different in their output voltages and currents. Traditionally, different types of battery chargers for different batteries have been manufactured, wherein each has a different design and construction to suit the respective parameters of a particular type of batteries.

It has also been discovered, according to the present invention, that there is a growing trend to utilize an electronic circuitry for controlling the recharging process. The electronic control circuitry will be able to monitor the charging process and maintain or modify the output voltage or current of the battery charger at different stages of the recharging process. The electronic components of such electronic control circuits can be arranged and retained on printed circuit boards (PCBs). However, for different types of battery chargers, the respective PCBs also need to be different.

It has been discovered, however, according to the present invention, that designing and constructing a particular type of transformer battery charger for each particular type of rechargeable batteries makes manufacturing transformer battery chargers less efficient and more expensive. It is desirable to have a standardized transformer battery charger assembly which can be used as the framework for assembling transformer battery chargers with different parameters.

It has therefore been discovered, according to the present invention, that the various components of a transformer battery charger, including the primary and secondary windings of the transformer and the PCB, can be all contained in a standardized two-piece casing to be assembled as a self-contained unit.

It has also been discovered, according to the present invention, that the parameters of a transformer battery charger are determined by the primary and secondary windings of the transformer, and the electronic elements on the PCB. If these components are interchangeably assembled in the standardized casing, then transformer battery chargers having different parameters can be assembled with the standardized casings with the interchangeable components.

It has further been discovered, according to the present invention, that the primary and secondary bobbins of the transformer in the self-contained transformer battery charger can also be standardized because the characteristics of a transformer are determined by the number of windings on the respective bobbins. Therefore, standardized primary and secondary bobbins can be manufactured and utilized, and different transformers can be made by merely altering the number of windings on the respective bobbin.

It has been additionally discovered, according to the present invention, that if the standardized two-piece casing maintains a heat exchange relationship with the components such as the PCB assembled inside the casing then the two-piece casing serves as a heat sink to increase the reliability of the electronic elements on the PCB.

Therefore, a primary object of the present invention is to provide a standardized transformer battery charger assembly that can be utilized in manufacturing transformer battery chargers with different parameters to suit the specific needs of charging different rechargeable batteries.

Another object of the present invention is to provide a standardized heavy duty two-piece casing for the transformer battery charger, so that the components of a transformer battery charger, such as the PCB and the primary and secondary windings of the transformer, can be all assembled in the standardized two-piece casing as a self-contained unit.

Still another object of the present invention is to provide an interchangeable assembly of the transformer battery charger, so that PCBs or primary and secondary windings with different parameters can be interchangeably assembled inside the standardized casing for providing the desired transformer battery charger characteristic to accommodate certain particular type of rechargeable batteries.

A further object of the present invention is to provide standardized primary and secondary bobbins as part of the standardized transformer battery charger assembly, so that different transformation requirements can be achieved by merely changing the respective number of windings on the primary and secondary bobbins, without the need of manufacturing different sized primary and secondary bobbins.

An additional object of the present invention is to provide a standardized heavy duty two-piece casing which maintains a heat exchange relationship with the components such as the PCB assembled in the casing, so the heavy duty casing also serves as a heat sink to increase the reliability of the electronic elements on the PCB.

Described generally, the present invention is a standardized transformer battery charger assembly for assembling a self-contained transformer battery charger with a built-in PCB. The transformer batter charger assembly comprises a two-piece casing for housing a transformer unit and the PCB. The PCB has a heat exchange relationship with the casing. The transformer unit includes a primary piece having a primary bobbin for accommodating a primary winding, and a secondary piece having a secondary bobbin for accommodating a secondary winding. The assembly also comprises electrical input pins mounted to the primary piece and connectable with the primary winding, secondary pins non-twistably and non-extractably attached to the secondary piece for supporting the PCB and electrically connecting the secondary winding with input terminals of the PCB, and terminal strips non-twistably and non-extractably attached to the primary piece and non-rotatably interlocking the second piece and also supporting the PCB at another end, and further electrically connected with output terminals of the PCB for serving as output terminals of the transformer battery charger. With the standardized transformer battery charger assemblies, various self-contained transformer battery chargers with customized characteristics can be produced by selecting desired combination of the respective number of windings on the primary and secondary bobbins and selecting suitable PCBs.

One essential novelty of the present invention transformer battery charger assembly is that all the components of a transformer battery charger, including a PCB, and the primary and secondary bobbins of transformer, are interchangeably assembled in the two-piece casing as a self-contained unit.

Another novel feature of the present invention transformer battery charger assembly is that it utilizes multipurpose terminal strips. The elongated terminal strips achieve multiple objectives in the transformer battery charger assembly. The terminal strips will serve as an attachment means for orienting and interlocking the primary and the secondary bobbins of the transformer and establishing an interference fit between the bobbins. The terminal strips will further serve as supporting stands for the PCB installed inside the transformer battery charger assembly. In addition, the terminal strips will serve as output terminal pins for the transformer battery charger.

A further uniqueness of the present invention is that the two-piece casing of the transformer battery charger assembly also serves as a heat sink for the electronic components, such as the transformer windings and the electronic elements on the PCB. Since all electronic components are assembled with a self-contained small unit, it is vitally important to have adequate means for dispersing the heat generated, to increase the reliability and durability of the electronic components of the transformer battery charger assembly. In the present invention, a direct heat exchange relationship is established between the PCB and the two-piece casing for effectively disperse the heat.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated:

FIG. 3 is an exploded perspective view of the two-piece casing of the transformer battery charger assembly.

FIG. 5 is a perspective view of the terminal strip of the present invention transformer battery charger assembly.

FIG. 6 is a perspective view of the secondary pin of the present invention transformer battery charger assembly.

FIG. 9 is a perspective view of the lamp cover on the cover piece of the transformer battery charger casing.

DESCRIPTION OF THE PREFERRED EMBODIMENT

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
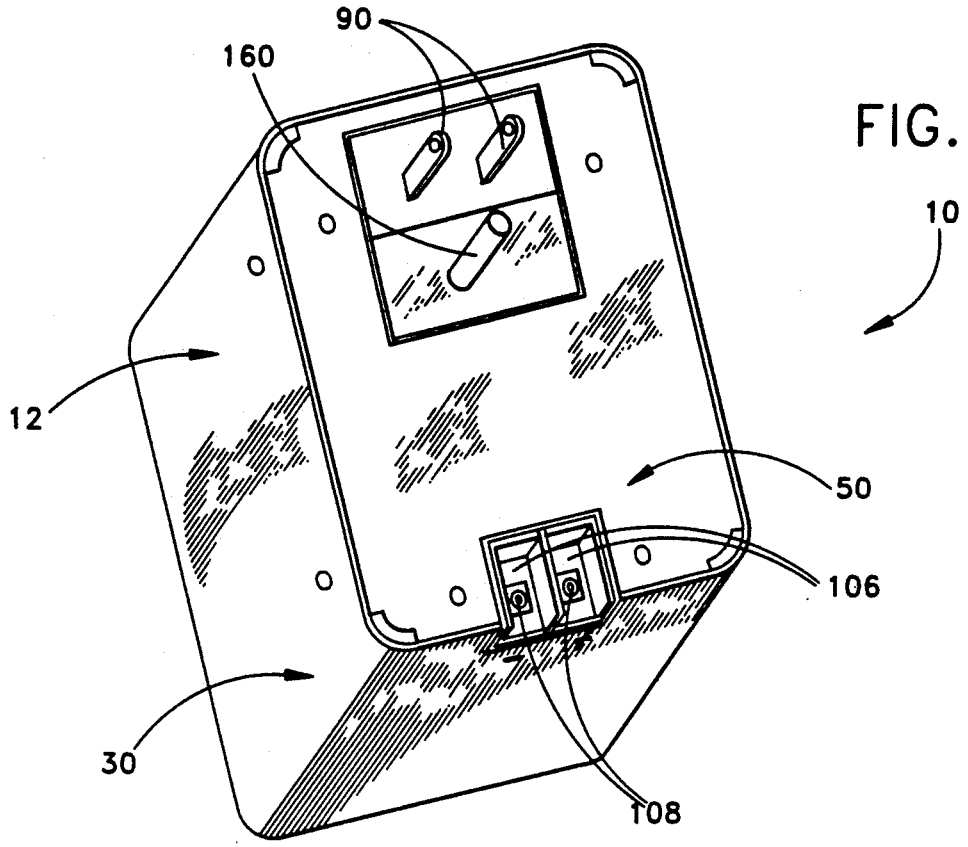
FIG. 1 is a perspective view of the present invention standardized and self-contained transformer battery charger.
Figure 2:
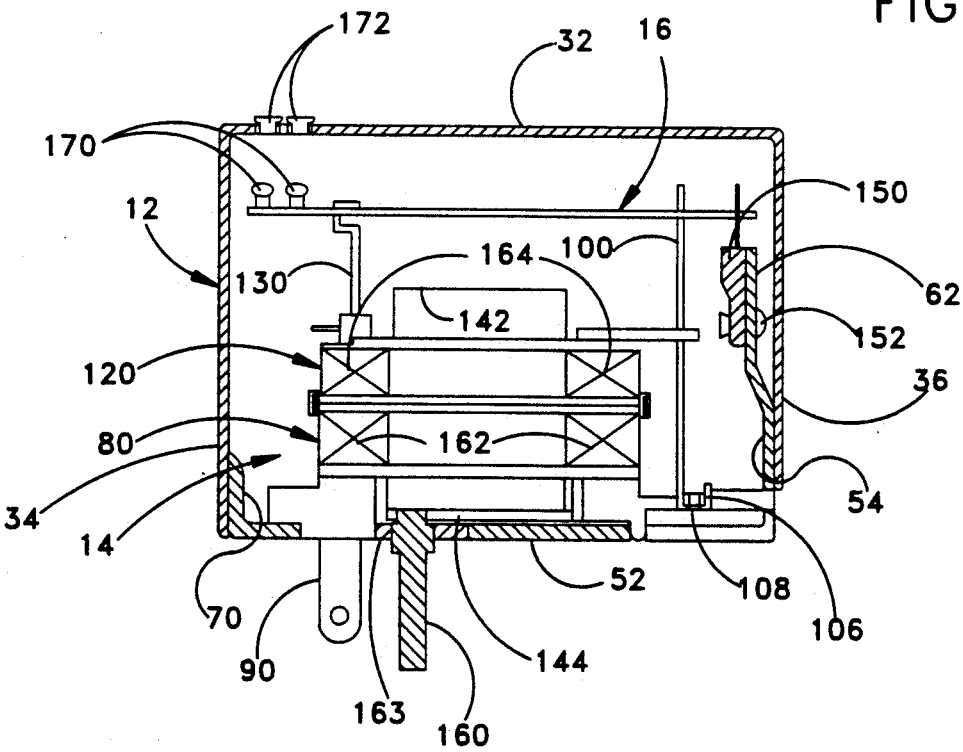
FIG. 2 is a partial cross-sectional and exposed side view of the interior structure of the transformer battery charger assembly.

Referring to FIG. 1, there is shown at 10 a transformer battery charger. The outside look of the transformer battery charger 10 appears like a "black box": the components are all self-contained inside a casing 12. The internal structure of the transformer battery charger 10 is illustrated in FIG. 2, where it can been seen that a transformer unit 14 is assembled inside the casing 12, and a printed circuit board (PCB) 16 is also assembled inside the casing 12 and supported by the transformer unit 14, and further connected with the casing 16. The structure and features shown in FIGS. 1 and 2 will be discussed later, after the detailed description of the various components of the transformer battery charger 10.

Referring to FIG. 3, the casing 12 of the transformer battery charger 10 is a two-piece casing, including a unitary cover piece 30 and a unitary base piece 50. Both the cover piece 30 and the base piece 50 are made of metallic materials. Metallic materials are preferred because of their strength, durability, ability to shield external electronic and magnetic interference, and relatively high heat conductivity. By way of example, the metallic material used for manufacturing the two-piece casing 12 of the present invention is thick anodized black aluminum.

The cover piece 30 has a generally rectangular shaped configuration. The cover piece 30 has a top plate 32, a front plate 34, a rear plate 36 which is opposite to the front plate 34, and two opposite side plates 38. The top plate 32, the front end plate 34, the rear end plate 36 and the two side plates 38 are integrally connected and enclose an internal hollow chamber or compartment 40 with a bottom opening 42, which in fact is just the uncovered side of the cover piece 30. The rear end plate 36 has a lower notch 44. The top plate 32 has one or more small apertures 46, and the two opposite side plates 38 each have two space apart screw holes 48. The function of these detailed features will become apparent later.

The base piece 50 of the two-piece casing 12 has a bottom plate 52 and an integrally connected upright rear plate 54. The bottom plate 52 has a front opening 56 and a rear notch 58. The upright rear plate 54 has a lower notch 60 which is aligned and connected with the rear notch 58 of the bottom plate 52. The upper portion 62 of the upright rear plate 54 is bent forward and provided with a screw hole 64.

The base piece 50 also includes two opposite side rails 66 which are integrally connected with the bottom plate 52. The two side rails 66 can facilitate the snug fit of the base piece 50 and the cover piece 30. Each of the two side rails 66 has two spaced apart screw holes 68. When base piece 50 is assembled with the cover piece 30 to form an enclosure, the two side rails 66 are brought into contact with the two side plates 38 of the cover piece 30 respectively. The screw holes 68 on the two rails 66 of the base piece 50 are aligned with the screw holes 48 on the side plate 38 of the cover piece 30 correspondingly, so that the cover piece 30 and the base piece 50 can be fastened together by small screws or bolts.

The base piece 50 further includes a front rail 70 integrally connected with the bottom plate 52. The front rail 70 can further facilitate the snug fit of the base piece 50 and the cover piece 30. As shown in FIG. 2, when base piece 50 is assembled with the cover piece 30 to form the enclosure, the front rail 70 and the upright rear plate 54 are brought into contact with the front plate 34 and the rear plate 36 of the cover piece 30 respectively.

In addition, a pair of screw holes 72 is provided on the bottom plate 52 of the base piece 50, adjacent to the front opening 56 thereof. Another pair of screw holes 74 is also provided on the bottom plate 52 of the base piece 50, adjacent to the rear notch 58 thereof. The function of these screw holes is for mounting the transformer unit 14 to the base piece 50 of the casing 12. In addition, a small screw hole 76 may also be provided on the bottom plate 52 of the base piece 50 for mounting a bottom piece of a transformer shield, which will be described later.

Figure 4:
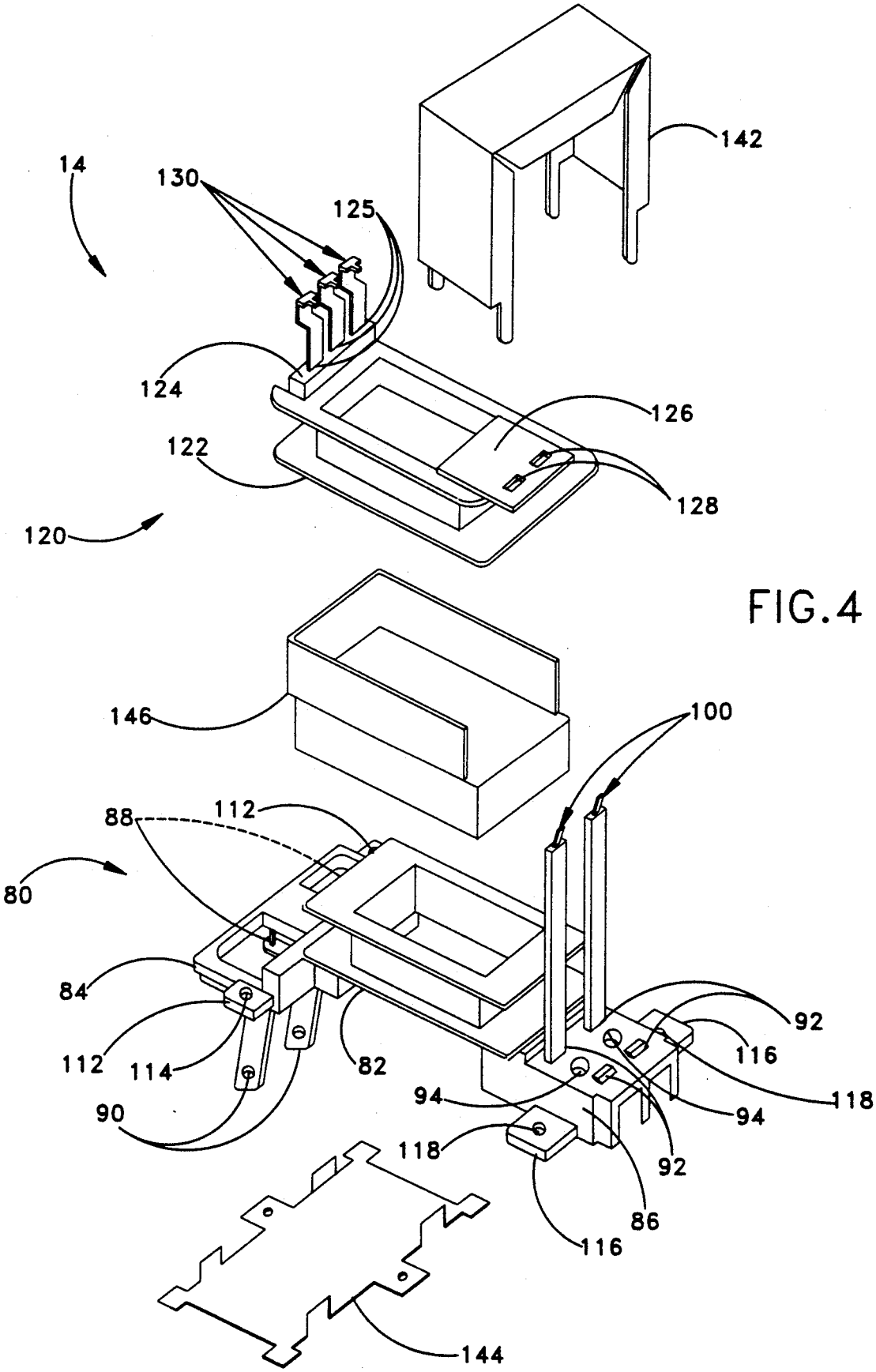
FIG. 4 is an exploded perspective view of the transformer components of the present invention assembly.

Referring to FIG. 4, there is shown an exploded perspective view of the various components of the transformer unit 14. The two essential components of the transformer unit 14 are a primary piece 80 and a secondary piece 120. Both the primary piece 80 and the secondary piece 120 are made of plastic materials. Plastic materials are preferred because of their adaptability, durability and electrical insulation. The plastic materials used should be able to sustain relatively high temperature.

The primary piece 80 includes a primary bobbin 82, a front block 84 and a rear block 86, all integrally connected. The primary bobbin is capable of receiving a primary winding. The front block 84 has two spaced apart slots 88 for adapting a pair of input pins 90, which can be electrically connected with the primary winding. The pair of input pins 90 are preferably non-removably mounted to the front block 84 of the primary piece 80. The rear block 86 has two pairs of slots 92, and two screw holes 94. Each screw hole 94 is positioned between a respective pair of slots 92. The two pairs of slots 92 are designed for attaching two terminal strips 100.

The terminal strips 100 are made of electrically conductive material. The detailed configuration of a terminal strip 100 is shown in FIG. 5. Terminal strip 100 has an upper end 102, a middle elongated portion 104 and a lower U-shaped bent section 106. A screw hole 108 is provided at the lower U-shaped bent section 106. Referring back to FIG. 4, the terminal strip 100 is attached to the rear block 86 of the primary piece 80 by inserting its upper end 102 and middle elongated portion 104 through a respective slot 92 thereof from the underneath side of the primary piece 80, until the "legs" of the lower U-shaped bent section 106 are snap-fit with both slots of a respective pair of slots 92, and the screw hole 108 at the lower bent section 106 is aligned with and adjacent to the screw hole 94 between the respective pair of slots 92. This attachment ensures that, not only the terminal strip 100 is non-twistably and non-extractably fitted to the rear block 86 of the primary piece 80, but also its lower bent section 106 is exposed at the underneath side of the rear block 86 of the primary piece. It is noted that the snug fitting of the terminal strip 100 makes them non-twistable in any direction, and non-extractable with normal forces. However, they are still detachable or removable if needed.

Referring again to FIG. 4, it is shown that the front block 84 of the primary piece 80 has two lateral "ears" 112 each provided with a screw hole 114. Similarly the rear block 86 of the primary piece 80 also has two lateral "ears" 116 each provided with a screw hole 118. These ears 112 and 116 and screw holes 114 and 118 are provided for the purpose of attaching the primary piece 80 of the transformer unit 14 to the base piece 50 of the easing 12. When the primary piece 80 is attached to the base piece 50, the front block 84 is positioned adjacent to the front opening 56 of the bottom plate 52, and the rear block 86 is positioned adjacent to the rear notch 58 of the bottom plate 52. The screw holes 114 on the ears 112 of the front block 84 are aligned respectively with the pair of screw holes 72 on the bottom plate 52, and the screw holes 118 on the ears 114 of the rear block 86 are aligned respectively with the pair of screw holes 74 on the bottom plate 52, so that the primary piece 80 can be fastened to the base piece 50 by small screws or bolts.

The secondary piece 120 includes a secondary bobbin 122, a front bar 124 and a rear plate 126, all integrally connected. The secondary bobbin is capable of receiving a secondary winding. The front bar 124 has three slots 125 for receiving three secondary pins 130 respectively, which can be electrically connected with the secondary winding. The rear plate 126 has two small apertures 128 for interlocking with the two terminal strips 100 respectively.

The secondary pins 130 are made of electrically conductive material similar to that used for the terminal strips 100. The detailed configuration of a secondary pin 130 is shown in FIG. 6. Secondary pin 130 has an upper end 132, a middle portion 134 and a lower end 136. Referring back to FIG. 4, the secondary pin 130 is attached to the front bar 124 of the secondary piece 120 by inserting its lower end 136 and middle portion 134 down into a respective slot 125 thereof, until the secondary pin 130 is snap-fit with the slot 125. This attachment ensures that the secondary pins 130 are non-twistably and non-extractably attached to the front bar 124 of the secondary piece 120. Again, it is noted that the snug fitting of the secondary pins 120 makes them non-twistable in any direction, and non-extractable with normal forces, but they are still detachable or removable if desired.

Still referring to FIG. 4, it is shown that the secondary piece 120 can be non-rotatably interlocked to the primary piece 80 by inserting the two terminal strips 100 through the two apertures 128 on the rear plate 126 of the secondary piece 120 respectively. This non-rotatable interlocking will secure the secondary bobbin 122 in a stacked relationship with the primary bobbin 82, as it is preferred for constructing the transformer unit 14.

The transformer unit 14 may also include a transformer shield formed by two snugly fitted pieces including a U-shaped piece 142 and a bottom piece 144, both made of metallic material such as thick zinc plate. The transformer unit 14 may further include a bobbin sleeve 146 made of non-conductive material such as hard nylon.

Figure 7:
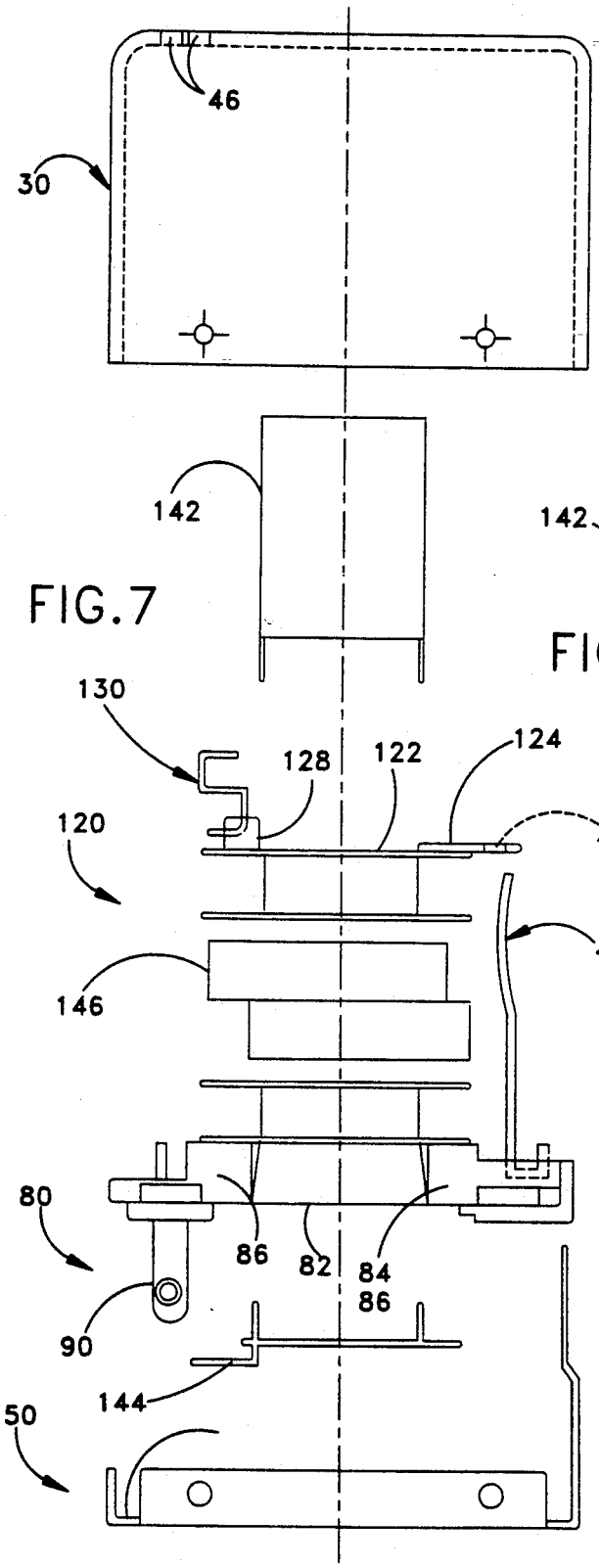
FIG. 7 is an exploded side view of the present invention transformer battery charger assembly.
Figure 8:
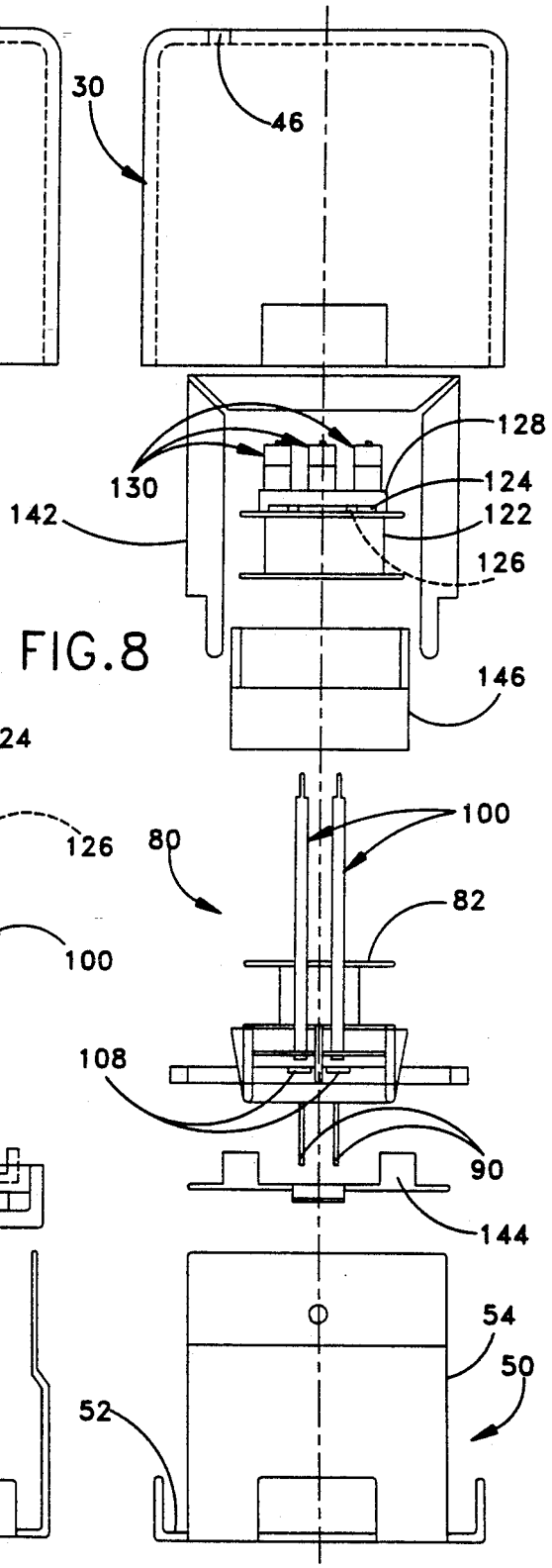
FIG. 8 is an exploded end view of the present invention transformer battery charger assembly.

An exploded side view and an exploded rear end view of the transformer battery charger assembly 10 are shown in FIGS. 7 and 8 respectively. Once the transformer battery charger assembly 10 is fully assembled with the PCB 16, it is a completely self-contained unit as shown in FIGS. 1 and 2. The method of assembling a particular transformer battery charger may be described as the following steps:

(a) a desired number of windings are wound on the primary bobbin 82 of the primary piece 80 of the transformer unit 14 as the primary winding 162 of the transformer unit 14 (see FIG. 2), and a desired number of windings are wound to the secondary bobbin 122 of the secondary piece 120 of the transformer unit 14 as the secondary winding 164 of the transformer unit 14 (see FIG. 2);

(b) the two terminal strips 100 are non-twistably and non-extractably fitted to the primary piece 80 of the transformer unit 14, and the three secondary pins 130 are non-twistably and non-extractably fitted to the secondary piece 120 of the transformer unit 14;

(c) the primary piece 80 of the transformer unit 14 is fastened to the base piece 50 of the casing 12, with the bottom piece 144 of the transformer shield placed underneath the primary bobbin 82, where the bottom piece 144 of the transformer shield may be fastened to the base piece 50 by a small screw or bolt through the single screw hole 76 on the base piece 50;

(d) the bobbin sleeve 146 is placed over the primary bobbin 82 of the primary piece 80 of the transformer unit 14;

(e) the secondary piece 120 of the transformer unit 14 is non-rotatably interlocked with the two terminal strips 100, so that the secondary bobbin 122 thereof is secured in a stacked relationship with the primary bobbin 82 of the primary piece 80 of the transformer unit 14, with the bobbin sleeve 146 covering both the primary bobbin 82 and the secondary bobbin 122;

(f) the U-shaped piece 142 of the transformer shield is placed over both the primary bobbin 82 and the secondary bobbin 122 and snugly attached with the bottom piece 144 of the transformer shield, to form a complete shielding of the primary winding 162 and the secondary winding 164;

(g) the PCB 16 is supported by the respective upper ends of the three secondary pins 130 and the two terminal strips 100, the three secondary pins 130 provide electrical connection between the secondary winding 164 and the input terminals of the PCB, and the two terminal strips 100 are electrically connected to the output terminals of the PCB, where one of the two terminal strips 100 is connected to the positive output terminal of the PCB and serves as the positive output terminal of the transformer battery charger 10, and the other one of the two terminal strips 100 is connected to the negative output terminal of the PCB and serves as the negative output terminal of the transformer battery charger 10;

(h) a bridge member 150 is used for interconnecting the PCB to the upper portion 62 of the upright rear plate 54 of the base piece 50 of the casing 12, where the bridge member 150 is made of materials which have relatively high heat conductivity, such as metallic materials, for providing a heat exchange relationship between the PCB and the casing 12, so that the casing 12 can serve as a heat sink of the internal components of the transformer battery charger 10;

(i) finally, the cover piece 30 of the casing 12 is placed over the transformer unit 14 and the PCB 16 and fastened to the base piece 50, where the rear upright plate 54 of the base piece 50 is brought into contact with the rear plate 36 of the cover piece 30, so heat can be transferred from the upper portion 62 of the upright plate 54 of the base piece 50 to the rear plate 36 of the cover piece 30, while the upper portion 62 of the upright rear plate 54 is bent forward in order to leave a clearance for a mounting screw 152 which is mounted through the screw hole 64 on the upper portion 62 of the upright plate 54 of the base piece 50.

In addition, a grounding pin 160 may be utilized. The grounding pin can be placed through a small plastic plate 163 and attached to the bottom piece 144 of the transformer shield. The small plastic plate 162 in turn may be snugly fitted with the front block 84 of the primary piece 80 and positioned over the front opening 56 of the bottom plate 52 of the base piece 50.

Furthermore, the PCB 16 may have one or more visual indicators, such as light emitting diodes (LEDs) 170, for indicating the operating status of the transformer battery charger 10. For example, one LED 170 may be a red light LED which when lighted indicates that the transformer battery charger 10 is electrically connected to an input power source such as an alternating current (AC) power outlet, and another LED 170 may be a green light LED which when lighted indicates that the transformer battery charger 10 is charging an external rechargeable battery. The small apertures 46 on the top plate 32 of the cover piece 30 serves as displaying windows of such visual indicators. A small lens or lamp cover 180 made of transparent plastic material may be placed into each of the small apertures 46 on the top plate 32 of the cover piece 30.

Referring to FIG. 9, there is shown a perspective view of the small lens or lamp cover 180. It generally has a lens portion 182 and a leg portion 184, which are integrally connected. The leg portion 184 can be snugly fitted into a small apertures 46, as shown in FIG. 2.

Referring back to FIG. 1, once the cover piece 30 is closed onto the base piece 50, the transformer battery charger 10 becomes a self-contained and compact unit. Only the two input pins 90, the grounding pin 160, and the exposed bent sections 106 of the two terminal strips 100 are exposed at the outside of the casing 12. The exposed bent section 106 of one terminal strip serves as the positive output terminal of the transformer battery charger 10, and is marked by a "+" sign on the casing 12, and the exposed bent section 106 of the other terminal strip serves as the negative output terminal of the transformer battery charger 10, and is marked by a "−" sign on the casing 12. Each exposed bent section 106 has a respective screw hole 108 which can be used to fasten an external electrical wire or like conductors which leads to the independent battery to be charged.

The present invention transformer battery charger has many unique and superior qualities which are represented by, but not limited to, the following advantages.

First, the present invention provides a standardized transformer battery charger assembly that can be utilized in producing customized transformer battery chargers to suit the needs of charging different rechargeable batteries. The standardized components, including the primary piece 80 and the secondary piece 120 of the transformer unit 14, the input pins 90, the terminal strips 100, the secondary pins 120, grounding pin 160, the transformer shield pieces 142 and 144 and the the bobbin sleeve 146, the bridge member 150 and the lamp covers 180, can all the manufactured in large quantities and in identical configurations, regardless of the characteristics of the final transformer battery chargers.

The present invention also provides a standardized heavy duty casing 14 which includes a standardized cover piece 30 and a standardized base piece 50, so that the various components of a transformer battery charger, including the transformer unit 14 and the PCB 16 can be all assembled in the standardized two-piece casing as a self-contained unit.

In addition, the present invention provides an interchangeable assembly of the transformer battery charger, so that the PCB 16 or the primary piece 80 and the secondary piece 120 with different parameters can be interchangeably assembled inside the standardized casing 12 for providing a customized transformer battery charger to accommodate certain particular types of rechargeable batteries. The interchangeability also makes it possible to replace a single failed part in repairing the unit, without throwing away the whole unit.

Furthermore, the present invention provides a relatively high heat conductive casing 12 which maintains a heat exchange relationship with the components such as the PCB 16 assembled in the casing 12, so the casing 12 can also serve as a heat sink to increase the reliability of the electronic elements on the PCB.

The novel features of the present invention transformer battery charger assembly also include that it utilizes two multi-purpose terminal strips 100 and three multi-purpose secondary pins 120. The elongated terminal strips 100 achieves multiple objectives in the transformer battery charger assembly. The terminal strips 100 serve as non-twistable and non-extractable attachment means for orienting and interlocking the primary and the secondary bobbins of the transformer unit 14 and establishing a non-rotatable interference fit between the bobbins. The terminal strips 100 also serve as supporting means for the PCB 16 which is installed inside the casing 12. The two terminal strips 100 further serve as the positive and negative output terminals respectively for the transformer battery charger. The three secondary pins 120 not only connect the secondary winding of the transformer unit 14 to the input terminals of the PCB 16, but also support the PCB 16.

Defined in detail, the present invention is a standardized and self-contained transformer battery charger assembly, comprising: (a) a two-piece rectangular casing including a unitary cover piece and a unitary base piece; (b) said unitary cover piece having a top plate, a front end plate and an opposite rear end plate, and two opposite side plates, the rear end plate having a lower notch; (c) said unitary base piece having a bottom plate and an upright rear plate, the bottom plate having a front opening and a rear notch, and the upright rear plate having a lower notch connected with the rear notch of the bottom plate; (d) a transformer unit including a unitary primary piece and a unitary secondary piece; (e) said primary piece having a front block and a rear block interconnected by a primary bobbin, the front block having slots for mounting two input pins made of electrical conductive material, the rear block having slots for accommodating two terminal strips, and the primary bobbin receiving a primary winding which is connected to the two input pins; (f) said secondary piece having a secondary bobbin attached with a front bar and a rear plate, the front bar having slots for accommodating three secondary pins, the rear plate having two apertures for interlocking with said two terminal strips, and the secondary bobbin receiving a secondary winding which is connected to the three secondary pins; (g) said two terminal strips being made of electrically conductive material and each having an upper end, a middle elongated portion non-rotatably interlocked with said front plate of said secondary piece to secure a stacked relationship between said primary and secondary bobbins, and a lower bent section non-twistably and non-extractably fitted to said rear block of said primary piece, one of said two terminal strips serving as a positive output terminal, another one of said two terminal strips serving as a negative output terminal; (h) said three secondary pins being made of electrically conductive material and each having an upper end, and a lower bent section non-twistably and non-extractably fitted to said front bar of said secondary piece; (i) means for attaching said primary piece of said transformer unit to said base piece of said casing, such that said front block of said primary piece is located adjacent to, and said two input pins thereofcan extend through, said front opening on said bottom plate of said base piece, and said rear block of said primary piece is located adjacent to, and said respective lower bent sections of said two terminal strips attached thereon are exposed through, said rear notch of said bottom plate of said base piece; (j) said two terminal strips and said three secondary pins interchangeably supporting a printed circuit board on their respective upper ends, such that said upper ends of said secondary pins can be connected to input terminals of the printed circuit board and said upper ends of said terminal strips can be connected to output terminals of the printed circuit board; (k) means for providing a heat exchange relationship between said printed circuit board and said casting through said upright rear plate of said base piece; and (l) means for attaching said cover piece of said casing to said base piece, such that said lower notch at said rear end plate of said cover piece is aligned with said lower notch at said upright rear plate of said base piece; (m) whereby said standardized transformer battery charger assembly can be used to produce a self-contained transformer battery charger with customized characteristics by selecting a desired combination of the respective number of windings on said primary and secondary bobbins and selecting a suitable printed circuit board.

Defined broadly, the present invention is a standardized and self-contained transformer battery charger assembly, comprising: (a) a two-piece casing including a cover piece and a base piece, the base piece having a front opening and a rear opening; (b) a transformer unit including a unitary primary piece and a unitary secondary piece, the primary piece including a primary bobbin, and the secondary piece including a secondary bobbin; (c) two input pins made of electrical conductive material and mounted to said primary piece for electrical connection with a primary winding which can be wound on said primary bobbin; (d) three secondary pins made of electrical conductive material and non-twistably and non-extractably attached to said secondary piece for electrical connection with a secondary winding which can be wound on said secondary bobbin; (e) two elongated terminal strips made of electrical conductive material and serving as a positive output terminal and a negative output terminal respectively, the two terminal strips each having a lower bent section non-twistably and non-extractably attached to said primary piece, and an upper elongated section non-rotatably interlocking said secondary piece to secure a stacked relationship between said primary and secondary bobbins; (f) means for attaching said primary piece of said transformer unit to said base piece of said casing, such that said two input pins can extend through said front opening said base piece, and said respective lower bent sections of said two terminal strips can be exposed through said rear opening of said base piece; (g) a printed circuit board supported by said two terminal strips and said three secondary pins above said transformer unit within said casing, the printed circuit board having input terminals which can be connected with said three secondary pins, the printed circuit board also having output terminals which can be connected with said two terminal strips; (h) means for providing a heat exchange relationship between said printed circuit board and said casing; and (i) means for attaching said cover piece to said base piece; (j) whereby said standardized transformer battery charger assembly can be used to produce a self-contained transformer battery charger with customized characteristics by selecting a desired combination of the respective number of windings on said primary and secondary bobbins and selecting a suitable printed circuit board.

Defined more broadly, the present invention is a standardized transformer battery charger assembly for assembling a self-contained transformer battery charger with a built-in printed circuit board, comprising: (a) a casing having an internal compartment for housing a transformer unit and said printed circuit board; (b) said transformer unit including a unitary primary piece and a unitary secondary piece, the primary piece including a primary bobbin for accommodating a primary winding, and the secondary piece including a secondary bobbin for accommodating a secondary winding; (c) electrical input means mounted to said primary piece and connectable with said primary winding; (d) means non-twistably and non-extractably attached to said secondary piece for supporting said printed circuit board at one end and electrically connecting said secondary winding with input terminals of said printed circuit board; (e) means non-twistably and non-extractably attached to said primary piece and non-rotatably interlocking said second piece and also supporting said printed circuit board at another end, and further electrically connected with output terminals of said printed circuit board for serving as output terminals of said transformer battery charger; (f) means for attaching said primary piece of said transformer unit to said casing; and (g) means for providing a heat exchange relationship between said printed circuit board and said casing; (h) whereby said standardized transformer battery charger assembly can be used to produce a self-contained transformer battery charger with customized characteristics by selecting a desired combination of the respective number of windings on said primary and secondary bobbins and selecting a suitable printed circuit board.

Defined alternatively, the present invention is a method for assembling a self-contained transformer battery charger with a built-in printed circuit board from a standardized transformer battery charger assembly, the method comprising the steps of: (a) producing a two-piece casing for said transformer battery charger, including a cover piece and a base piece; (b) producing a transformer unit including a primary piece including a primary bobbin for accommodating a primary winding, and a secondary piece including a secondary bobbin for accommodating a secondary winding; (c) mounting input means to said primary piece for electrical connection with the primary winding; (d) attaching terminal means to said primary piece in a non-twistable and non-extractable manner, using the terminal means to non-rotatably interlock said secondary piece for securing a stacked relationship between said primary and secondary bobbins, also using the terminal means to support said printed board at one end, and further electrically connecting the terminal means to output terminals of said printed circuit board for serving as output terminals of said transformer battery charger; (e) attaching secondary means to said secondary piece in a non-twistable and non-extractable manner for electrical connection between said secondary winding and input terminals of said printed circuit board, and using the secondary means to support said printed circuit board at another end; (f) mounting said primary piece of said transformer unit to said base piece of said casing; (g) providing a heat exchange relationship between said printed circuit board and said casing; and (h) fastening said cover piece to said base piece of said casing to enclose said transformer unit and said printed circuit board; (i) whereby a self-contained transformer battery charger with customized characteristics can be produced from said standardized transformer battery charger assembly selecting a desired combination of the respective number of windings on said primary and secondary bobbins and selecting a suitable printed circuit board.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modification in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. A standardized and self-contained transformer battery charger assembly, comprising:

a. a two-piece rectangular casing including a unitary cover piece and a unitary base piece;

b. said unitary cover piece having a top plate, a front end plate and an opposite rear end plate, and two opposite side plates, the rear end plate having a lower notch;

c. said unitary base piece having a bottom plate and an upright rear plate, the bottom plate having a front opening and a rear notch, and the upright rear plate having a lower notch connected with the rear notch of the bottom plate;

d. a transformer unit including a unitary primary piece and a unitary secondary piece;

e. said primary piece having a front block and a rear block interconnected by a primary bobbin, the front block having slots for mounting two input pins made of electrical conductive material, the rear block having slots for accommodating two terminal strips, and the primary bobbin receiving a primary winding which is connected to the two input pins;

f. said secondary piece having a secondary bobbin attached with a front bar and a rear plate, the front bar having slots for accommodating three secondary pins, the rear plate having two apertures for interlocking with said two terminal strips, and the secondary bobbin receiving a secondary winding which is connected to the three secondary pins;

g. said two terminal strips being made of electrically conductive material and each having an upper end, a middle elongated portion non-rotatably interlocked with said front plate of said secondary piece to secure a stacked relationship between said primary and secondary bobbins, and a lower bent section non-twistably and non-extractably fitted to said rear block of said primary piece, one of said two terminal strips serving as a positive output terminal, another one of said two terminal strips serving as a negative output terminal;

h. said three secondary pins being made of electrically conductive material and each having an upper end, and a lower bent section non-twistably and non-extractably fitted to said front bar of said secondary piece;

i. means for attaching said primary piece of said transformer unit to said base piece of said casing, such that said front block of said primary piece is located adjacent to, and said two input pins thereof can extend through, said front opening on said bottom plate of said base piece, and said rear block of said primary piece is located adjacent to, and said respective lower bent sections of said two terminal strips attached thereon are exposed through, said rear notch of said bottom plate of said base piece;

j. said two terminal strips and said three secondary pins interchangeably supporting a printed circuit board on their respective upper ends, such that said upper ends of said secondary pins can be connected to input terminals of the printed circuit board and said upper ends of said terminal strips can be connected to output terminals of the printed circuit board;

k. means for providing a heat exchange relationship between said printed circuit board and said casing through said upright rear plate of said base piece; and l. means for attaching said cover piece of said casing to said base piece, such that said lower notch at said rear end plate of said cover piece is aligned with said lower notch at said upright rear plate of said base piece;

m. whereby said standardized transformer battery charger assembly can be used to produce a self-contained transformer battery charger with customized characteristics by selecting a desired combination of the respective number of windings on said primary and secondary bobbins and selecting a suitable printed circuit board.

2. The invention as defined in claim 1 wherein said base piece of said casing further comprises a front rail integrally connected with said bottom plate for facilitating a snug engagement between said base and cover pieces of said casing, such that said front rail and said upright rear plate of said base piece can be brought in fitted contact with said front and rear plates of said cover piece.

3. The invention as defined in claim 1 wherein said base piece of said casing further comprises two opposite side rails integrally connected with said bottom plate for facilitating a snug engagement between said base and cover pieces of said casing, such that the two side rails of said base piece can be brought in fitted contact with said two opposite side plates of said cover piece.

4. The invention as defined in claim 1 wherein said transformer unit further comprises a transformer shield made of metallic material positioned within said casing over said stacked primary and secondary bobbins of said primary and secondary pieces of said transformer unit.

5. The invention as defined in claim 1 wherein said transformer unit further comprises a transformer sleeve made of plastic material positioned within said casing around said stacked primary and secondary bobbins of said primary and secondary pieces of said transformer unit.

6. The invention as defined in claim 1 wherein said transformer unit further comprises a grounding pin made of electrical conductive material and positioned in a triangular relationship with said two input pins and extending out of said front opening on said bottom plate of said base piece.

7. The invention as defined in claim 1 wherein said exposed bent section of each said terminal strips has means for facilitating the attachment of an external electrical wire.

8. The invention as defined in claim 1 wherein said means for attaching said cover piece of said casing base piece includes screw members.

9. The invention as defined in claim 1 wherein said means for attaching said primary piece of said transformer unit to said base piece of said casing includes screw members.

10. The invention as defined in claim 1 wherein said means for providing a heat exchange relationship between said printed circuit board and said casing through said upright rear plate of said base piece includes a heat conductive bridge member interconnecting said printed circuit board and said upright rear plate of said base piece.

11. The invention as defined in claim 1 wherein said cover and base pieces of said casing are made of metallic material.

12. The invention as defined in claim 1 wherein said printed circuit board has a visual indicator for signifying operating status, and said cover piece of said casing has a small aperture aligned with the visual indicator for serving as a displaying window.

13. The invention as defined in claim 12 wherein cover piece of said casing further comprises a small lens attached to said cover piece over said small aperture.

14. A standardized and self-contained transformer battery charger assembly, comprising:

a. a two-piece casing including a cover piece and a base piece, the base piece having a front opening and a rear opening;

b. a transformer unit including a unitary primary piece and a unitary secondary piece, the primary piece including a primary bobbin, and the secondary piece including a secondary bobbin;

c. two input pins made of electrical conductive material and mounted to said primary piece for electrical connection with a primary winding which can be wound on said primary bobbin;

d. three secondary pins made of electrical conductive material and non-twistably and non-extractably attached to said secondary piece for electrical connection with a secondary winding which can be wound on said secondary bobbin;

e. two elongated terminal strips made of electrical conductive material and serving as a positive output terminal and a negative output terminal respectively, the two terminal strips each having a lower bent section non-twistably and non-extractably attached to said primary piece, and an upper elongated section non-rotatably interlocking said secondary piece to secure a stacked relationship between said primary and secondary bobbins;

f. means for attaching said primary piece of said transformer unit to said base piece of said casing, such that said two input pins can extend through said front opening said base piece, and said respective lower bent sections of said two terminal strips can be exposed through said rear opening of said base piece;

g. a printed circuit board supported by said two terminal strips and said three secondary pins above said transformer unit within said casing, the printed circuit board having input terminals which can be connected with said three secondary pins, the printed circuit board also having output terminals which can be connected with said two terminal strips;

h. means for providing a heat exchange relationship between said printed circuit board and said casing; and i. means for attaching said cover piece to said base piece;

j. whereby said standardized transformer battery charger assembly can be used to produce a self-contained transformer battery charger with customized characteristics by selecting a desired combination of the respective number of windings on said primary and secondary bobbins and selecting a suitable printed circuit board.

15. The invention as defined in claim 14 wherein said base piece of said casing further comprises an integral upright plate for facilitating a snug engagement between said base and cover pieces of said casing, such that said upright plate of said base piece can be brought in fitted contact with said cover piece.

16. The invention as defined in claim 15 wherein said means for providing a heat exchange relationship between said printed circuit board and said casing includes a heat conductive bridge member interconnecting said printed circuit board and said upright plate of said base piece.

17. The invention as defined in claim 14 wherein said transformer unit further comprises a grounding pin made of electrical conductive material and positioned in a triangular relationship with said two input pins and extending out of said front opening of said base piece.

18. The invention as defined in claim 14 wherein said means for attaching said cover piece of said casing to said base piece includes screw members.

19. The invention as defined in claim 14 wherein said means for attaching said primary piece of said transformer unit to said base piece of said casing includes screw members.

20. The invention as defined in claim 14 wherein said printed circuit board has a visual indicator for signifying operating status, and said cover piece of said casing has a small aperture aligned with the visual indicator for serving as a display window.

21. A standardized transformer battery charger assembly for assembling a self-contained transformer battery charger with a built-in printed circuit board, comprising:

a. a casing having an internal compartment for housing a transformer unit and said printed circuit board;

b. said transformer unit including a unitary primary piece and a unitary secondary piece, the primary piece including a primary bobbin for accommodating a primary winding, and the secondary piece including a secondary bobbin for accommodating a secondary winding;

c. electrical input means mounted to said primary piece and connectable with said primary winding;

d. means non-twistably and non-extractably attached to said secondary piece for supporting said printed circuit board at one end and electrically connecting said secondary winding with input terminals of said printed circuit board;

e. means non-twistably and non-extractably attached to said primary piece and non-rotatably interlocking said second piece and also supporting said printed circuit board at another end, and further electrically connected with output terminals of said printed circuit board for serving as output terminals of said transformer battery charger;

f. means for attaching said primary piece of said transformer unit to said casing; and g. means for providing a heat exchange relationship between said printed circuit board and said casing;

h. whereby said standardized transformer battery charger assembly can be used to produce a self-contained transformer battery charger with customized characteristics by selecting a desired combination of the respective number of windings on said primary and secondary bobbins and selecting a suitable printed circuit board.

22. The invention as defined in claim 21 wherein said means for providing a heat exchange relationship between said printed circuit board and said casing includes a heat conductive bridge member interconnecting said printed circuit board and said casing.

23. The invention as defined in claim 21 wherein said electrical input means attached to said primary piece and connectable with said primary winding includes two input pins.

24. The invention as defined in claim 21 wherein said means attached to said secondary piece for supporting said printed circuit board at one end and electrically connecting said secondary winding with input terminals of said printed circuit board includes two secondary pins.

25. The invention as defined in claim 21 wherein said means attached to said primary piece and interlocking said second piece and also supporting said printed circuit board at another end, and further electrically connected with output terminals of said printed circuit board for serving as output terminals of said transformer battery charger include a positive terminal strip and a negative terminal strip.

26. A method for assembling a self-contained transformer battery charger with a built-in printed circuit board from a standardized transformer battery charger assembly, the method comprising the steps of:

a. producing a two-piece casing for said transformer battery charger, including a cover piece and a base piece;

b. producing a transformer unit including a primary piece including a primary bobbin for accommodating a primary winding, and a secondary piece including a secondary bobbin for accommodating a secondary winding;

c. mounting input means to said primary piece for electrical connection with the primary winding;

d. attaching terminal means to said primary piece in a non-twistable and non-extractable manner, using the terminal means to non-rotatably interlock said secondary piece for securing a stacked relationship between said primary and secondary bobbins, also using the terminal means to support said printed circuit board at one end, and further electrically connecting the terminal means to output terminals of said printed circuit board for serving as output terminals of said transformer battery charger;

e. attaching secondary means to said secondary piece in a non-twistable and non-extractable manner for electrical connection between said secondary winding and input terminals of said printed circuit board, and using the secondary means to support said printed circuit board at another end;

f. mounting said primary piece of said transformer unit to said base piece of said casing;

g. providing a heat exchange relationship between said printed circuit board and said casing; and h. fastening said cover piece to said base piece of said casing to enclose said transformer unit and said printed circuit board;

i. whereby a self-contained transformer battery charger with customized characteristics can be produced from said standardized transformer battery charger assembly by selecting a desired combination of the respective number of windings on said primary and secondary bobbins and selecting a suitable printed circuit board.

* * * * *